US007204614B2

(12) United States Patent
Hanis et al.

(10) Patent No.: US 7,204,614 B2
(45) Date of Patent: Apr. 17, 2007

(54) PORTABLE, AUTOMATED ILLUMINATION DEVICE

(75) Inventors: Kerri E. Hanis, Chesterfield, MO (US); Lawrence R. Happ, Mundelein, IL (US); Mark Hanis, Chesterfield, MO (US)

(73) Assignee: Beacons, LLC, Chesterfield, MO (US)

( * ) Notice: Subject to any disclaimer, the term of this patent is extended or adjusted under 35 U.S.C. 154(b) by 0 days.

(21) Appl. No.: 10/963,253

(22) Filed: Oct. 12, 2004

(65) Prior Publication Data

US 2005/0078481 A1 Apr. 14, 2005

Related U.S. Application Data

(60) Provisional application No. 60/509,585, filed on Oct. 9, 2003.

(51) Int. Cl.
*F21V 31/00* (2006.01)
*F21L 4/00* (2006.01)

(52) U.S. Cl. ..... 362/276; 362/267; 362/190; 362/154

(58) Field of Classification Search ..... 362/276, 362/802, 190, 154, 155, 253, 267; 206/5, 206/6

See application file for complete search history.

(56) References Cited

U.S. PATENT DOCUMENTS 4,722,038 A 1/1988 Comfort
6,163,248 A 12/2000 Pack et al.
6,390,648 B1 * 5/2002 Privas et al. ..... 362/276
6,402,338 B1 * 6/2002 Mitzel et al. ..... 362/154
6,749,319 B1 * 6/2004 Muse ..... 362/154
2003/0043578 A1 3/2003 Lessard

FOREIGN PATENT DOCUMENTS

DE 10109713 9/2002
WO WO 01/17637 3/2001
WO WO 2005/036052 4/2005

* cited by examiner

*Primary Examiner*—Sandra O'Shea
*Assistant Examiner*—Peggy A. Neils
(74) *Attorney, Agent, or Firm*—Womble Carlyle Sandridge & Rice, PLLC

(57) ABSTRACT

A portable, automated illumination device is provided that is capable of illuminating an item stored on or near the device, such items may include eyeglasses, drinking cups, or other household articles. In one embodiment, the device includes a top section platform that has a sloped, nearly vertical edge to retain items and a sensor that instantly illuminates a light in response to motion adjacent to the device. In certain embodiments, the light provides illumination of the surrounding area to allow a user to find an item stored in or near the device, or to locate a more significant light source. Preferably, the light is illuminated for a certain period of time, after which the device resets to be triggered by subsequent motion, heat, or other stimuli detectable by the sensor.

41 Claims, 7 Drawing Sheets

PORTABLE, AUTOMATED ILLUMINATION DEVICE

RELATED APPLICATION

This application is a non-provisional application claiming the benefit of Provisional Application Ser. No. 60/509,585, filed Oct. 9, 2003, the content of which is hereby incorporated by reference herein in its entirety.

FIELD OF THE INVENTION

The present invention relates generally to a portable illumination device. In certain embodiments, the device is capable of illuminating an item and its surrounding area in response to sensing the presence of an object.

BACKGROUND OF THE INVENTION

Finding objects in the middle of the night or in an otherwise darkened or darkened space is difficult without turning on a lamp or other light source. After a light switch is located and turned on, the lamp typically provides an unnecessary excess of illumination. This excess light can flood the surrounding area with light, can be obtrusive to other persons in the room, and can cause discomfort to a person whose eyes are not prepared to receive excessive light.

A person with impaired vision can experience additional problems or inconvenience when attempting to locate objects in a darkened or darkened space. Poor eyesight that engenders the need to wear eyeglasses can be the root cause of such impaired vision. Many people who rely on eyeglasses on a daily basis find it challenging to locate eyeglasses on a bedside table or to locate a switch to turn on a bedside lamp when waking in the middle of the night. Also, the particular eye sensitivity that one experiences when waking in a dark room and immediately being exposed to excessive light can be another source of impaired, albeit generally temporary, vision.

What is needed is a lighting apparatus that, preferably, provides unobtrusive or passive lighting, is easily powered on and off, and that can illuminate items on or near such apparatus. The unobtrusive or passive lighting serves as a beacon to direct the user toward a sought object while preserving a comfort level by not exposing the user's eye to excessive lighting.

SUMMARY OF THE INVENTION

To address these and other problems, the present portable, automated illumination device is provided.

According to one embodiment of the invention, the portable illumination device comprises a sensor capable of detecting the presence of an object and a light source which illuminates when the sensor detects the presence of such object. Preferably, the light source illuminates an item and its surrounding area for a set interval of time. The sensor may be capable of detecting one or more stimuli, such as motion or heat differentials. In certain preferred embodiments, the device includes an internal power supply.

According to another embodiment of the invention, the portable illumination device, preferably, illuminates an item with passive or unobtrusive light.

According to further embodiments of the invention, the device is capable of receiving and storing items, including items such as eyeglasses, drinking cups, other household items, and is capable of illuminating the items with a light disposed therein. In certain alternative embodiments, the device is capable of illuminating such items placed near the device.

According to still further embodiments, methods of illuminating a portable item in a darkened room or darkened space are provided. More specifically, such methods comprise storing the item in, on, or near a portable illuminating device of the present invention; providing the device with a sensor; sensing the presence of an object with the sensor; and illuminating the item upon sensing the presence of such object. Preferably, the item is illuminated with passive or unobtrusive light. In certain preferred embodiments, the methods further comprise providing the device with an internal power source.

DETAILED DESCRIPTION OF THE PREFERRED EMBODIMENTS

Figure 1:
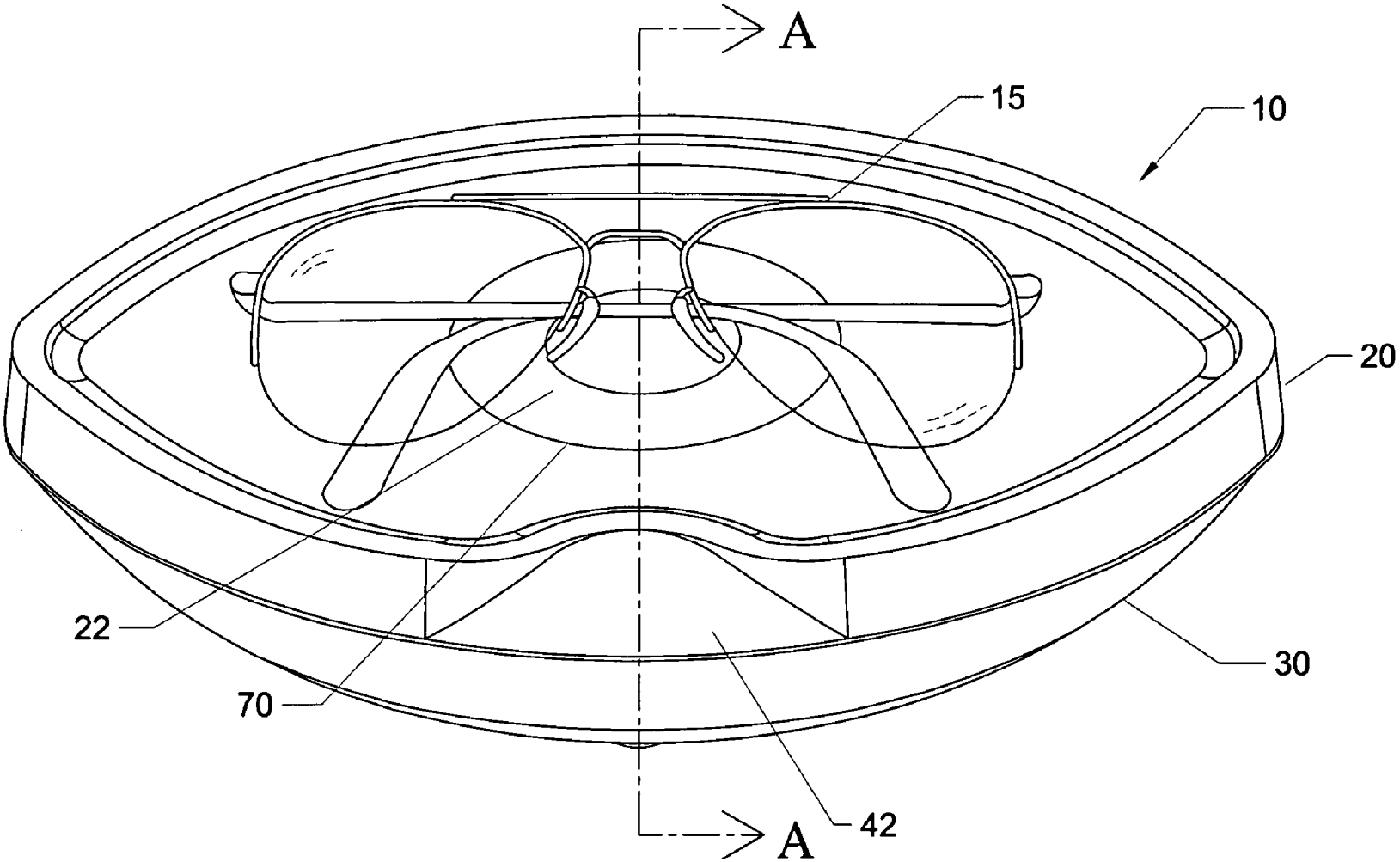
FIG. 1 is a perspective view of a portable, automated illumination device.
Figure 2:
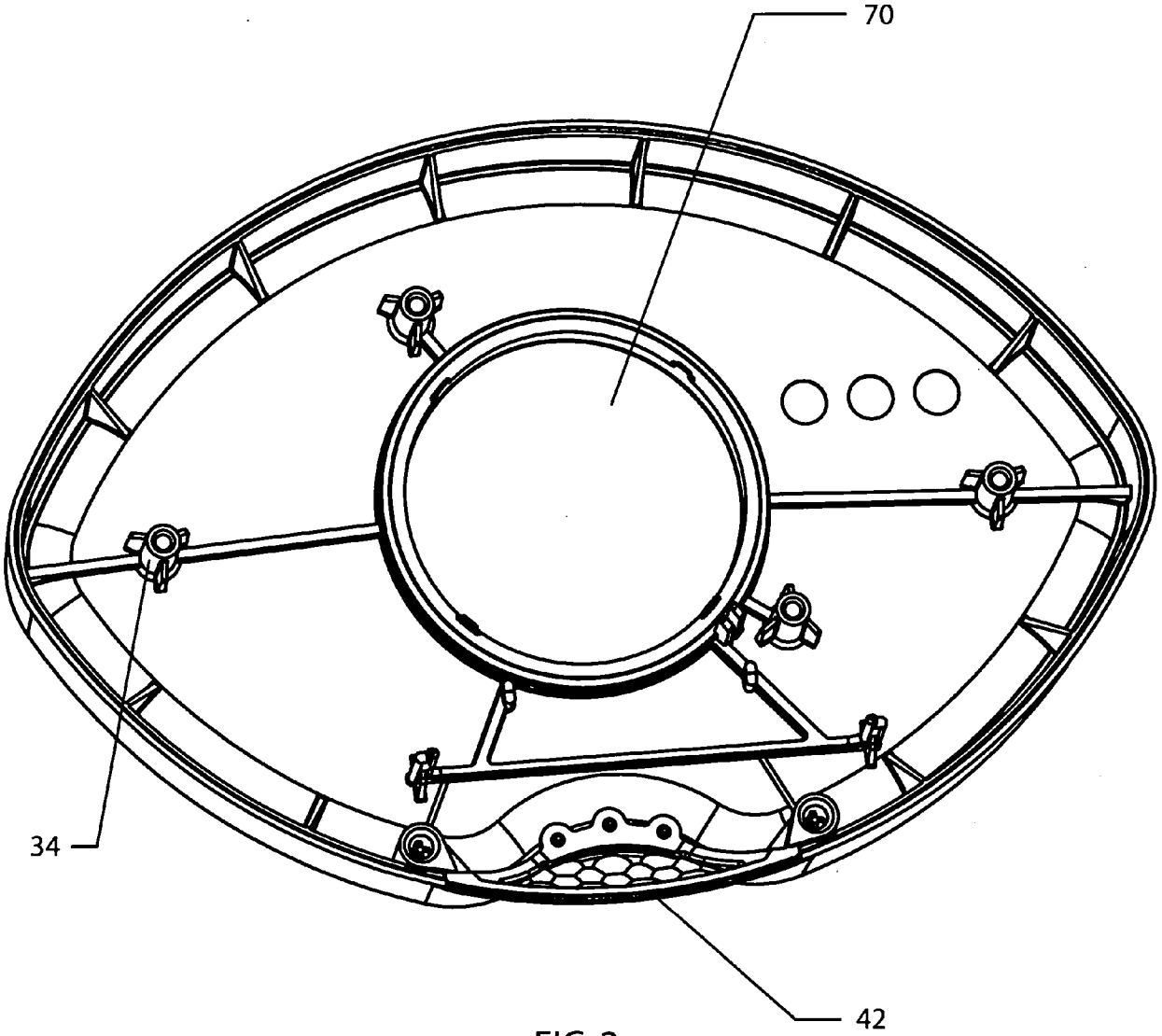
FIG. 2 is an underside view of the platform part of the device of FIG. 1.

The following will describe in detail several preferred embodiments of the invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

In one embodiment, the present invention provides a portable illumination device. Preferably, the device comprises a sensor capable of detecting the presence of an object. The device further comprises a light source which, preferably, illuminates in response to the sensor detecting the presence of an object. In certain embodiments, the light source, preferably, illuminates a portable item and its surrounding area. Of course, the identity of the portable item that is illuminated is not particularly germane to the present invention. Rather, the item may be any object or thing, such as, for example, eyeglasses, drinking cup(s), remote controls, or any other household item.

The portable illumination device of the present invention, preferably, comprises a sensor capable of detecting stimuli produced by an object consisting of heat, motion, a combination thereof, or any other detectable stimuli (currently existing or discovered hereafter). In certain preferred embodiments, the invention contemplates that such object is a person. Depending on the type of sensor employed in the current invention, and its relative sensitivity to the detectable stimuli, the device may detect the presence of an entire person, a portion thereof, such as a hand or arm, or an object in control of the person.

More particularly, the range of motion (and the location of the device in relation thereto), amount of heat differential, or magnitude of other stimuli necessary for the sensor to detect the presence of the respective object may vary considerably—depending on the desired application of the device. For example, the device may be configured to detect the presence of a person's hand or arm over a bedside table to illuminate an item placed thereon. In other examples, the device may be configured to detect the entry of a person through a walkway, which illuminates a desired item, such as the walkway itself, a light switch, lamp, eyeglasses, etc.

In certain preferred embodiments, the device produces passive light upon detecting the presence of an object. The device preferably comprises an internal power source; however, in other embodiments, the device may be powered using external sources, such as a wall outlet. Alternatively, in certain embodiments, the device may be configured to operate from an internal or external power source, whereby the user may select the appropriate power source based on the location of the device and its intended use.

Preferably, the illuminating device of the present invention is portable. More particularly, the invention provides that the device may be transported to any desired location, such as a bedside table, coffee table, or any other location within a home or building. Although the device of the present invention is portable, the invention provides that it may be temporarily affixed to a desired location, such as to a wall. Thus, the term "portable," as used herein in connection to the device, means that the device is transferable and, for example, may be periodically moved from room or room or affixed to a wall for an indeterminate period of time.

The invention further provides that items illuminated thereby may exist on or in the device or, alternatively, near the device. In certain embodiments, for example, the device comprises an area in which items may be placed. Upon sensing the presence of an object, the device illuminates the item placed therein. In other embodiments, the invention provides that items may be placed in the area surrounding the device, wherein upon sensing the presence of an object, the device illuminates the item in its surrounding area.

In certain alternative embodiments, the portable illuminating device of the present invention is part of, or affixed to, the item to be illuminated. More specifically, for example, the invention contemplates that the illuminating device of the present invention may be adapted to form a part of any item, whereby, upon detecting the presence of an object, the light source of the device illuminates the item to which it is associated. The invention provides, for example, that such embodiments may be useful in connection with remote controllers, whereby the light source of the device is activated in response to the sensor detecting the presence of an object, e.g., a person. Of course, the location of the sensor and light source are not particularly germane to such embodiments; provided, however, that the sensor is capable of detecting such object, either through motion, heat differentials, or other stimuli, and the resulting illumination is visible.

Still further, the invention provides that the device may be removably affixed to an item. The methods and mechanical fixtures that are required to configure the portable illuminating device of the invention to be removably attachable to an item are well-known to those of skill in the art. For example, the device may be equipped with clips, straps, ties, adhesives, magnets, Velcro® attachments, etc.

The casing of the device may be formed of any material now known or created hereafter, such as plastics, composites, steel, wood, etc. Preferably, the casing is designed to be aesthetically pleasing. In certain preferred embodiments, the device is comprised of plastic. The device may be formed of a solitary structural unit or, alternatively, it may comprise two or more pieces. For example, in certain embodiments, the device is formed by an enclosure with a top platform and a lower base section. Preferably, the device further comprises a sensor lens cover, a light chamber with disc cover, and a printed circuit board (PCB) assembly.

In certain embodiments, the PCB contains, preferably, three main components: a Pyro-electric Infra-Red (PIR) sensor for detecting the motion of an object warmer than the background temperature, such as a body part of the user, a Photocell that responds to ambient light level in the room to disable the device when a minimum threshold of light is detected, and a light emitting diode (LED) to provide sufficient passive lighting. Although the device could operate through or by household current, the device, preferably, operates with an internal power source, such as disposable or rechargeable batteries, so as to remain portable, lightweight, and economical. Generally, integrated circuits (ICs) are used to control circuit and LED timing, but these and other functions could be controlled by a programmable microchip.

In certain embodiments, the top part or platform of the device includes at least one area, such as a circular disc area that is translucent, clear, semi-transparent, or similarly capable of transmitting light there through. The top platform of the device is, optionally, shaped to accept items thereon. For example, the top portion of the device may, optionally, comprise a substantially flat surface surrounded by walls that are formed to facilitate object retention onto the surface. The objects stored thereon are, preferably, relatively lightweight and portable, e.g., eyeglasses, drinking cups, or other household articles, etc. In certain alternative embodiments, the device excludes such a platform, wherein the device is specially configured to illuminate items placed in its surrounding area. In other configurations, the base structure, or the bottom of the device generally, includes an enclosure and support arms connectable to the top portion, or platform as the case may be, of the device.

Several terms used herein should be afforded the breadth encompassed by the following definitions. The term "passive lighting" and "passive light" describes, for example, a level of lighting of desired color hue, of uniform low-light intensity, and of a time duration that is unobtrusive to the human eye in a darkened room or darkened space.

The terms "including" and "includes" are used herein in a nonexclusive manner and encompass items not specifically enumerated in any list. For example, throughout the specification, lists of items that can be stored and/or illuminated by the present illumination device begin with the introductory word "includes" or "including" and should be interpreted to encompass any item capable of storage or illumination by the present device, not merely those enumerated. For example, the term "household item" includes, without limitation, eyeglasses, sunglasses, readers; contact lens case(s) and solution; eyeglass case; objects that contain medication, such as pills, throat lozenges and syrups; medications; dental products, such as dental floss, toothbrush or pick(s); personal care products, such as hairbrush, comb, elastics, scissors; medical devices used to monitor patient care, such as sugar levels and pregnancy; drinking objects that contain hot and/or cold fluids; consumable snack items, such as fruit, vegetables, candy, suckers, cakes; consumer electronic products, such as wireless phones, cellular phones, personal digital assistants, television remote control units, handheld game consoles, baby monitoring devices, flashlights, clocks; personal accessories, such as wallet, money clip, jewelry, cufflinks; money and credit cards; any device that can be written on, such as a pad of paper, post-its and index cards; books; playing cards; compact disk(s); a writing instrument, such as pen, pencil or marker; keys and electronic key cards with magnetic strip(s); monetary unit(s); or the like.

The terms "dark room" or "darkened room" or "dark space" or "darkened space" encompass, for example, any manner of low-light areas or spaces in which the present device can provide illumination of objects or illumination of a path. Preferably, however, as detailed herein, the present device operates in an "off" or "standby" mode and only provides enough power to the sensing circuit to illuminate the light when the level of ambient light in a room has diminished enough or when the room or space is dark enough to need passive lighting assistance.

Still further, in certain embodiments, the device is capable of illuminating a portable item upon sensing the presence of an object for a set period of time and, following the expiration of such period, disabling the light source. In addition, certain embodiments provide that the sensor of such device is disabled for a certain period of time following its detection of an object. Preferably, the length of time during which the device illuminates an item may be adjusted at will.

The device preferably includes certain electronic components, such as a PIR sensor, lamp, battery compartment, timer, photocell and integrated circuits. In certain embodiments, a cover plate is affixed to the device, preferably, to less visible portions of the device, to provide access to certain components, e.g. batteries. Further, the transparent light chamber disc cover is, preferably, affixed to the top platform of the device, or to the portion of the device that is most likely to illuminate portable items in accordance with the intended use of the device, which allows passive light to emit from the device in response to the presence of a detected object. In certain embodiments, the device preferably comprises a sensor lens cover that is fabricated of materials which allow heat energy through so that the PIR sensor can detect proximate motion, heat, or a heat differential from a hand or other object passing within a certain distance thereby. Although the present specification makes reference to the use of PIR sensors in the present invention, those of ordinary skill in the art should appreciate that any sensor capable of detecting the presence of an object in accordance with the invention may be employed, e.g., any sensor that detects motion, heat differentials, combinations thereof, or any other stimuli.

The underside of the device, preferably, comprises obtrusions or other gripping materials that are designed to prevent sliding and to protect the surface, such as a bedside table, upon which the device is disposed. Alternatively, the device can be used as an illumination device solely and can be secured to surfaces. The obtrusions may, optionally, contain openings to accept screws, nails, or other features for securing the device onto vertical planes, such as walls, from the underside of a horizontal plane, or on slanted, non-horizontal surfaces. In addition, in certain embodiments, the device exhibits a modest footprint—to allow space for items placed nearby on any given surface.

The present invention further provides certain methods of illuminating a portable item in a darkened room or darkened space. In certain embodiments, the invention comprises (i) storing the item in, on, or near a portable illuminating device of the present invention, (ii) providing the device with a sensor, (iii) sensing the presence of an object with the sensor, and (iv) illuminating the item upon sensing the presence of the object. Preferably, the device ceases illumination of the item after a set period of time has lapsed. Still further, in certain embodiments, the methods further provide that after the initial period of time has lapsed, the sensor does not sense an object for an additional set period of time. Preferably, the set period of time after which the device ceases illumination may be increased or decreased.

In such embodiments, the sensor may detect motion, heat differentials, combinations thereof, or any other detectable stimuli. Preferably, the methods of the present invention further comprise providing the device with an internal power source as described above. Still further, the methods, preferably, illuminate the portable item using passive or unobtrusive light.

The following Example is included to demonstrate certain embodiments of the invention. It should be appreciated by those skilled in the art that the devices and methods disclosed in the Example that follows represent those discovered by the inventors to function well in the practice of the invention, and thus, can be considered to include modes for its practice. However, those of ordinary skill in the art should, in light of the present disclosure, appreciate that many changes can be made in the specific embodiments that are disclosed and still obtain a like or similar result without departing from the spirit and scope of the invention.

EXAMPLE

FIG. 1 is a perspective view of a portable, automated illumination device 10.

The device 10 generally comprises a plastic enclosure with a top platform 20 that serves as a platform that is capable of accepting and storing items 15, including eyeglasses, a drinking cup and other household items. Affixed to the top platform 20 is a lower base section 30, a sensor lens cover 42 and a light chamber disc cover 70, which generally comprises a circular disc area 22 that is translucent, clear, or similarly capable of transmitting light there through. When the top platform is properly positioned on the lower base part, the light chamber disk cover 70 securely mates with and covers a light chamber 62 (See FIG. 4), of the base. The device 10 is designed to provide passive lighting for a set interval of time after an object, such as a person's hand, passes in range of the PIR sensor 40 (See FIG. 5) or when the PIR sensor 40 detects a differential in heat signature. The range of the sensor is normally triggered to provide passive lighting when motion or heat is detected in a close enough proximity for the sensor to detect a differential. Accordingly, this range can be preset by the manufacturer or can be made adjustable to allow an end user to modify the range as desired.

Figure 5:
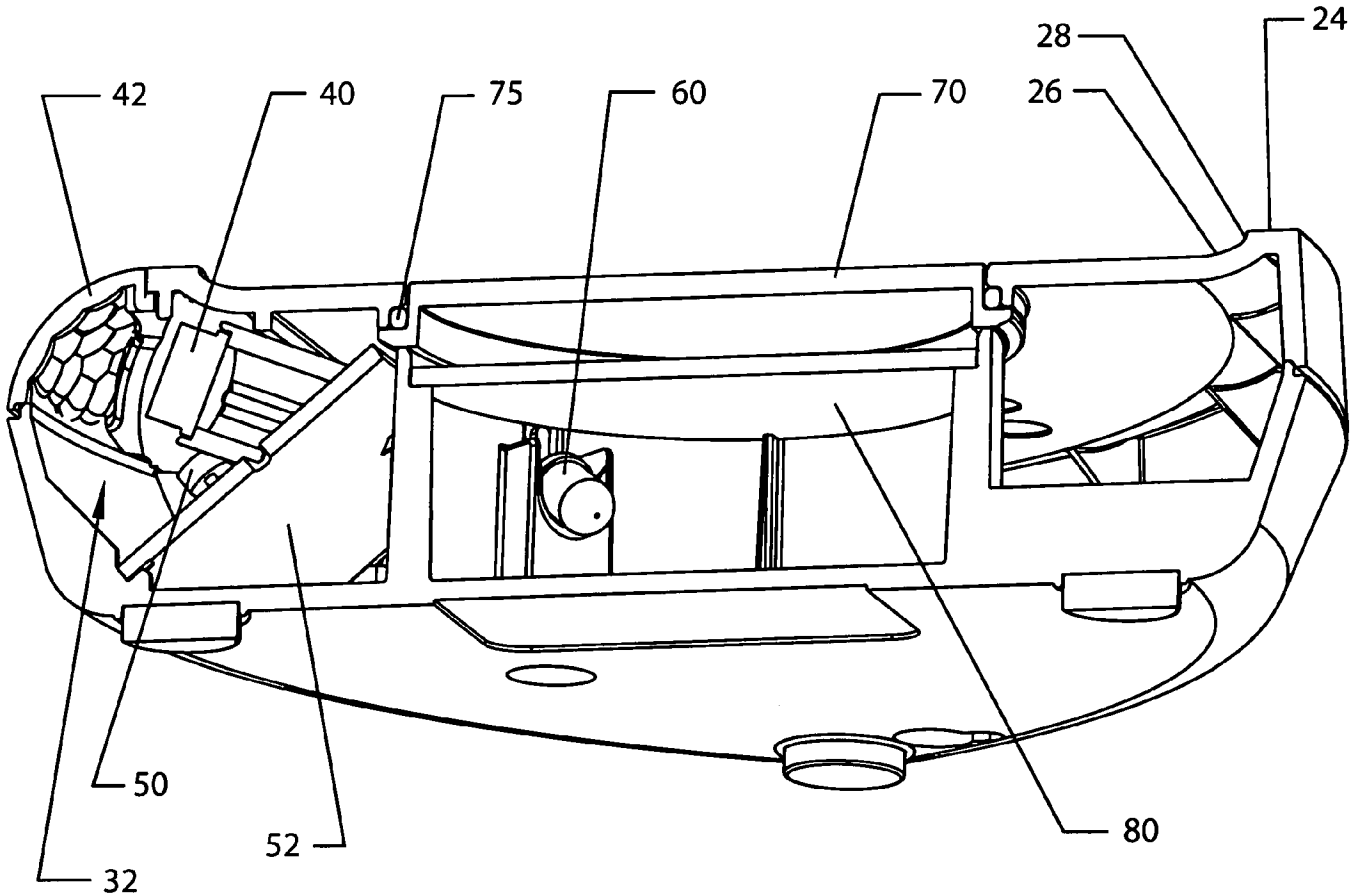
FIG. 5 is a cross-sectional view of the device of FIG. 1.

FIGS. 1 and 5 show the top section 20, which includes a containing wall 24, with a sloped portion 26 and a nearly vertical wall portion 28. Generally, the steeper the angle of the containing wall 24 (See FIG. 5), the higher protection the wall 24 provides to keep items 15 from sliding up, and/or over, the edge of the wall 24. However, since vertical walls generally are not pleasing aesthetically, in the embodiment shown in FIGS. 1 and 5, the platform edges of the wall 24 gradually slope upward from the platform surface, increasing in slope until becoming nearly vertical at the edge. Although extending only a short distance above the sloped portion 26 of containing wall 24, the vertical wall portion 28 provides almost identical protection to keep items from sliding off the device 10 as a full, vertical wall that extended from the platform would. Additionally, this wall geometry provides a substantially chamfered edge that is not harsh or bold in appearance with the near vertical section 28 being slight and such that the overall height of the wall 24 is approximately the thickness of common eyeglasses frames or stems. Generally, to achieve a highly aesthetic wall 24, the plastic molding manufacturing process limits the maximum slope of section 28 to approximately 1–2 degrees from vertical, though such embodiments of the invention should not be limited to this amount.

Referring in specific to FIGS. 1, 2, 5, 6, and 7, although the top platform section 20 and bottom section 30 in FIG. 1, could be formed of a single molded piece, the embodiment shown in these figures includes separate pieces that are installed together to act as a unit. The platform 20 includes a light chamber disc cover 70 attached by a seal 75 to the platform in FIG. 7. The light chamber disc cover 70 typically is molded in a colored translucent plastic, generally of a blue, green, a combination of blue and green, or any other color or color combination that compliments the receptive properties of the eye at low levels of light, to allow light transmission and is affixed to the platform 20 with seal 75 in a watertight manner. The light chamber disc cover 70 generally meets the upper surface of the platform 20 to form a level, even surface. The lower portion of the light chamber disc cover 70 generally fits within, or mates with, the base 30 to form a light chamber 62 as detailed further herein below.

Figure 6:
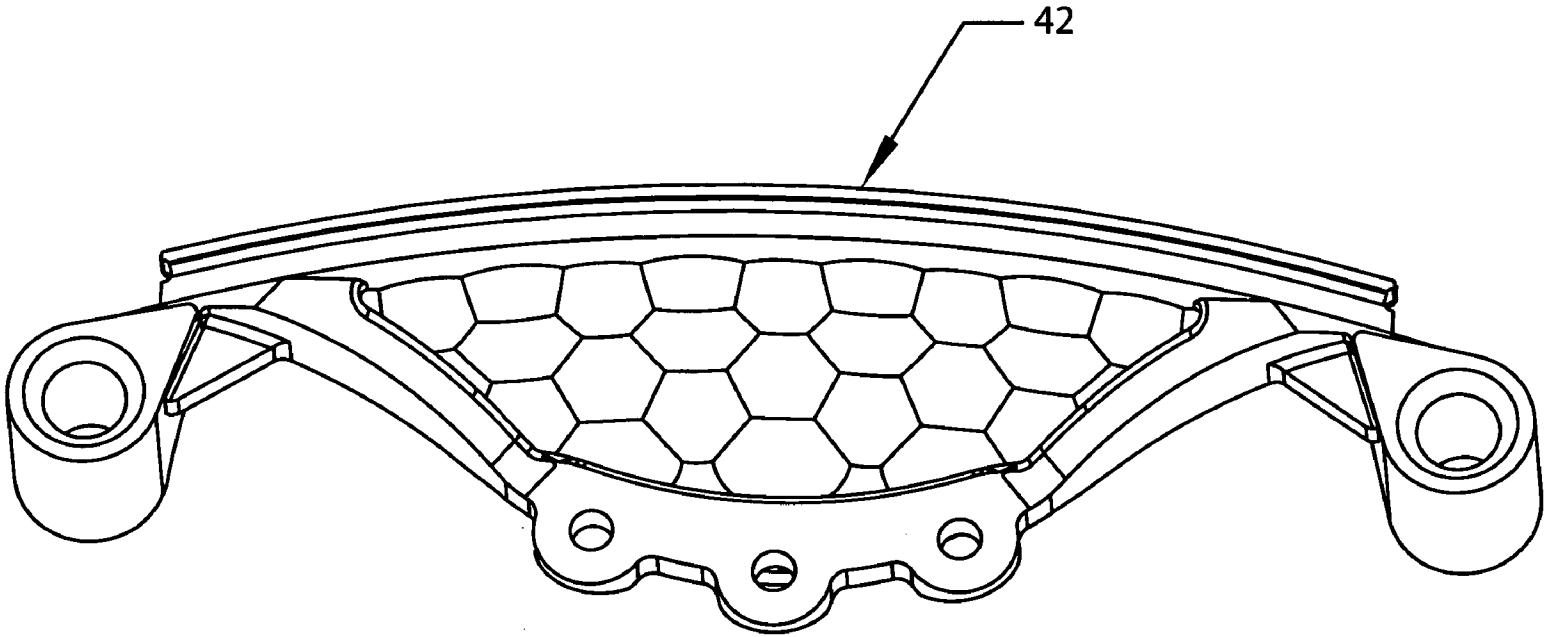
FIG. 6 is a perspective view of a sensor lens cover.
Figure 7:
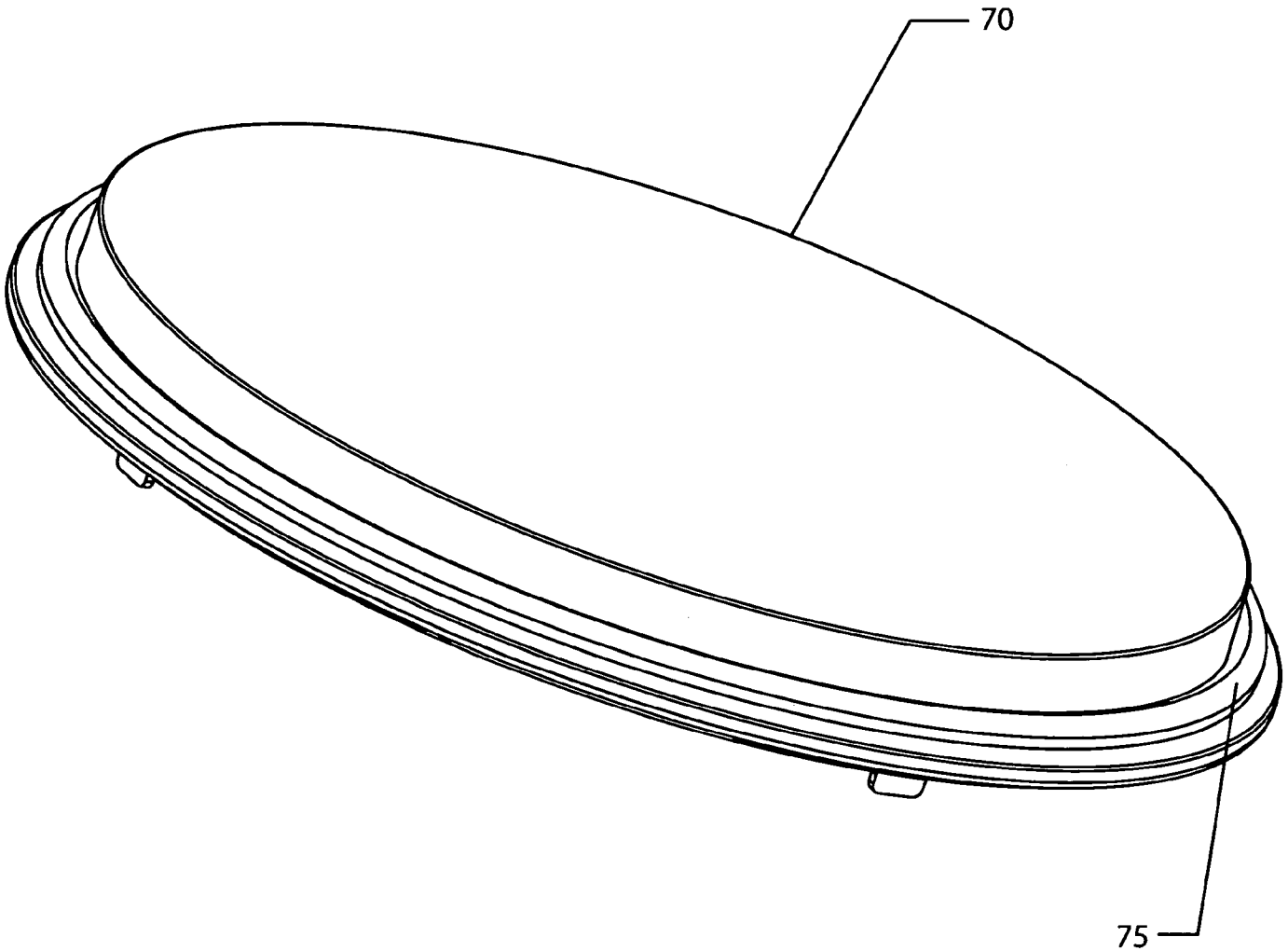
FIG. 7 is a perspective view of a light chamber disc cover.

As shown in FIGS. 5 and 6, a sensor lens cover 42 is provided that generally is attached to platform 20 at a side thereof. The sensor lens cover 42 generally covers a sensor 40 to shield the PIR sensor from air turbulence, which could generate false heat sensing modes, and to sense the proximate motion of a warm object passing in proximity thereby to activate the lamp 60. The sensor lens cover 42, shown in FIGS. 1, 2, 5, and 6, is installed by screws, alignment pins and bosses, or other attachment means and is disposed on the outer side of the wall 24. Disposed beneath the sensor lens cover 42, the PIR sensor, the photocell, logic and timing circuitry, and LED are disposed as attached to the base 30 and as detailed further herein below. The sensor lens cover can comprise a Fresnel or other arrangement of convex lenses to enhance sensitivity of the PIR sensor for triggering the light in the device from increased angles, ranges, or decreased intensities.

Figure 3:
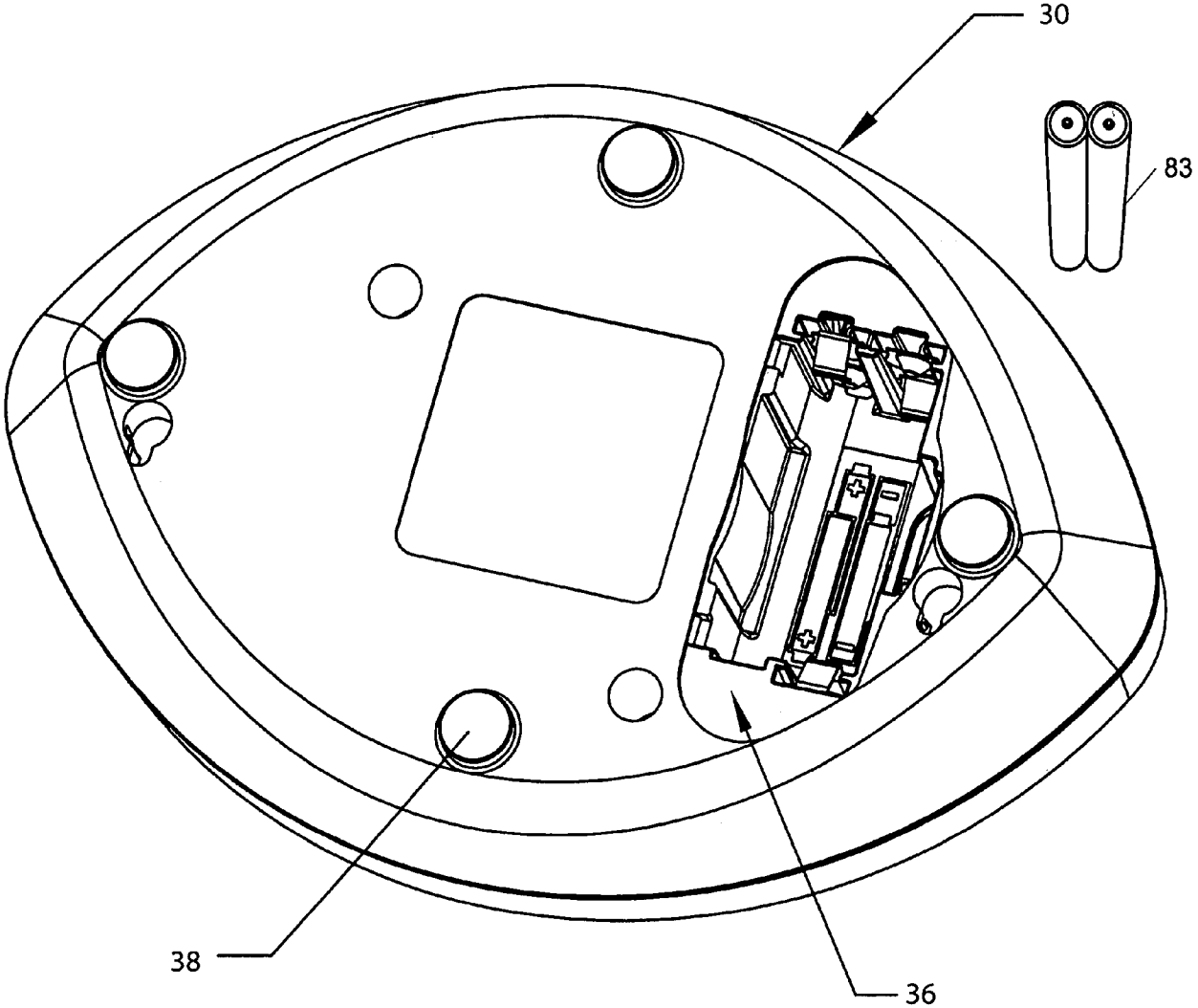
FIG. 3 is an underside view of the base part of the device of FIG. 1.
Figure 4:
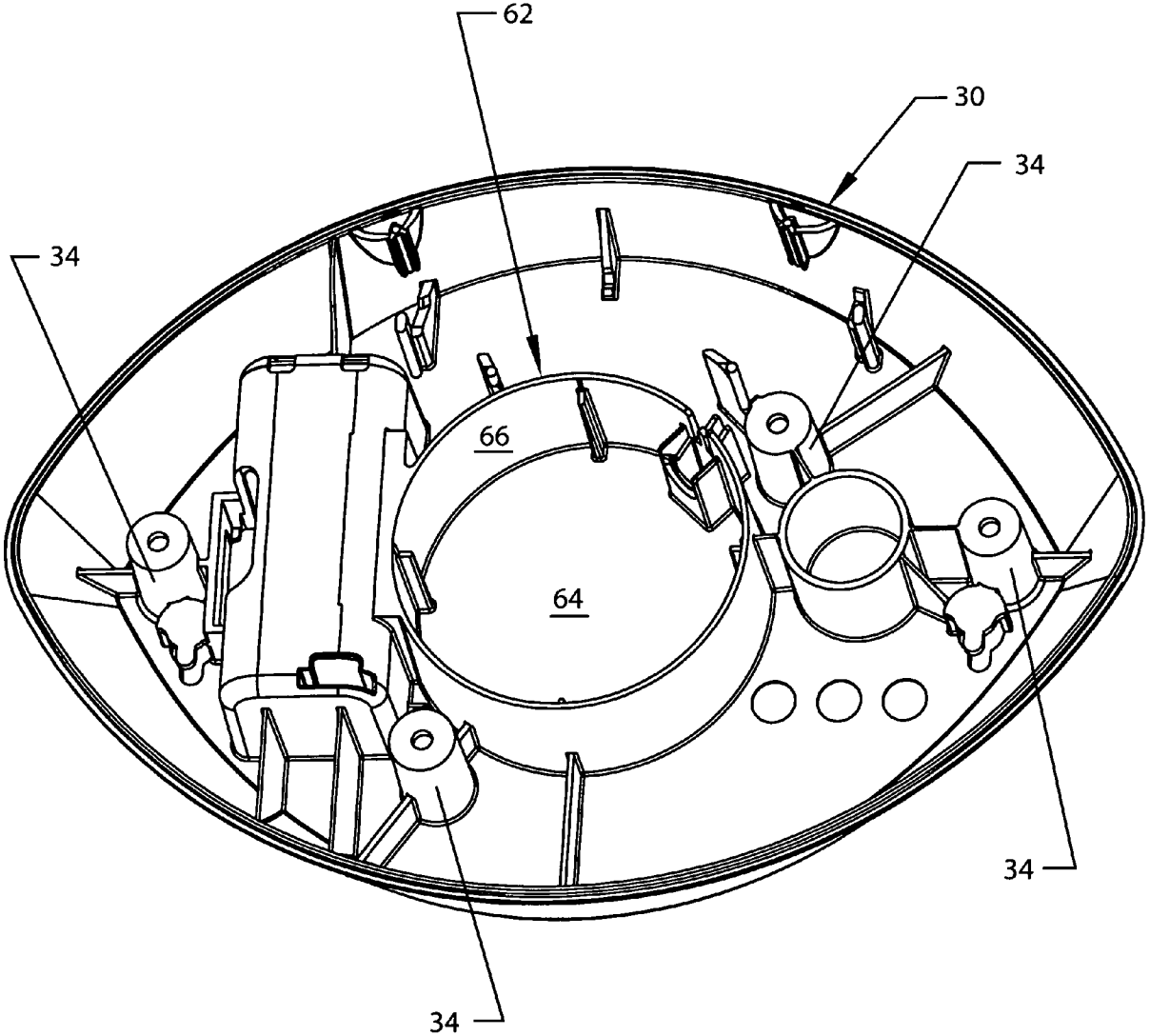
FIG. 4 is a top view of the base part of the device of FIG. 1.

As shown in FIGS. 3, 4 and 5, the base 30 generally comprises an enclosure 32, a light chamber 62, and screw holes 34. The enclosure 32 houses electronic components, generally including a PIR sensor 40, photocell 50, printed circuit board 52, and lamp 60 in FIG. 5.

A compartment 36 is included on the underside of the base 30 as shown in FIG. 3 to provide an area for insertion or replacement of batteries 83 or other power source. The compartment 36 can be covered by a removable cover plate (not shown). The underside of the enclosure contains obtrusions 38 that are designed to prevent sliding and protect furniture. The obtrusions 38 can be pads of felt, rubber, or other material to facilitate such protection to tables and other furniture. The base 30 typically contains openings capable of receiving screws or other fastening means to attach the device 10 onto vertical structures, such as a wall or to attach the device more securely to any other surface, where the device can be used more as a motion sensor than for storing and illumination of articles thereon.

In the base 30 within the light chamber 62, as shown in FIG. 5, at least one lamp or light 60 is positioned. In order to lessen the obtrusiveness of the light, the light intensity is kept at a minimum by utilizing a low number of LED's or by providing lower wattage bulbs. In order to avoid "hot spots" or other areas of increased or unbalanced light intensity, the LED's generally are positioned under the light chamber disk cover 70 and positioned so the majority of the emitted light reflects off the floor 64 of the light chamber. The embodiment shown uses only one LED lamp under light chamber disc cover 70 since additional bulbs consume proportionally more electrical power.

To further encourage even light distribution, the light from lamp 60 is reflected off the bottom of the light chamber floor through an intermediate layer or diffusion disk 80 before the light is allowed to exit through the light chamber disk cover 70. In addition the light reflected off the light chamber floor is positioned directly beneath a blackened center portion of the light chamber disc cover 70 to obscure the brightest center portion of the reflected light to the observer. To further encourage diffusion, a reflective paint or foil can be affixed to the interior walls and floor of the light chamber 62 and these surfaces can additionally be textured for reflection and scattering of the light upward.

In operation, the device 10 typically is secured to, or otherwise positioned on, a horizontal plane, such as the top of a bedside table 1. A household item 15, such as a pair of eyeglasses, is placed on the top platform of the device 10 and in the general area of the transparent light chamber disc cover. An object, such as a user's hand, is waved or otherwise passed in proximity to the device's PIR sensor, the light is energized, and the top surface of the device is illuminated for a period of time. A user is then able to use the passive lighting to more readily locate the item 15 in a darkened room or dark space or is afforded enough time to locate a more significant source of light. After the lamp 60 in FIG. 5 has been triggered and the set period of time passes, the illuminated apparatus turns off automatically and remains turned off until the PIR sensor detects another motion event. This dormant period during "non-sensing" of motion by the PIR sensor either can allow immediate re-illumination of the light after the PIR sensor 40 senses further motion or can include a delay during which the light 60 is not re-illuminated for a certain period of time, even if the PIR sensor 40 senses proximate motion. This delay provides a user time to get out of the range of the PIR sensor 40, such as to get back into bed. The set period of time can be a predetermined time interval set by the manufacturer or can be adjustable as desired by an end user.

The passive lighting effect of the light 60 in the device 10 provides a uniform and low level illuminated portion of the light chamber disk cover 70 of the top platform 20, which will allow a user to observe the location of the device 10, but will not distract other persons in the room, e.g. those who are asleep. This low level illumination generally does not disperse excessive light into the area surrounding the device 10.

LED lamps and other lights are available in a variety of intensities, shapes, colors, and light dispersion characteristics. To gain the most uniform spread of light through the light chamber disc cover, a light with a wide angle of viewing or dispersion is preferred. The light is directed downward toward the chamber floor 64 and allowed to reflect off the chamber floor 64 and chamber walls 66 to uniformly exit the light chamber disc cover 70 and create a uniform pattern of light. To add additional diffusion effect to the pattern of light exiting the chamber, a diffusion lens 80 is positioned at the top of the chamber below the light chamber disc cover 70. Together, the position of the LED, the direction and wide viewing angle of the light emitted from the LED, the reflective floor and walls of the light chamber, the diffusion lens, and the hue and color of the translucent light chamber disk cover all contribute to creating the passive lighting effect.

The available intensities of LEDs vary widely from 100 millicandelas to as much as 5000 millicandelas. Approximately 200–1000 millicandelas of light generally is sufficient to produce the passive lighting effect in the device as long as the light is efficiently and uniformly dispersed through the light chamber disc cover. Many choices of LED and light colors are available, including red, yellow, green, white, and blue. In one embodiment, a blue color was selected to enhance the passive lighting effect. To achieve maximum flexibility during the manufacturing process, a white LED can be used and the light chamber disc cover can be tinted blue. In addition to, or in alternative of, storing and illuminating an object stored thereon, the device is portable and can be used for its motion sensing properties to illuminate other articles, such as household items in a cabinet, household items in a closet, household items in a containment device, or other darkened spaces, including walkways, stairwells, and hallways.

Generally, the light utilized in the device has a low intensity to not be harsh or obtrusive to the human eye. This passive lighting generally is under 500 lux in intensity to avoid causing discomfort to a person's eye when the apparatus is activated and when the darkened area transitions to a lighted area by the passive lighting of the device. In one embodiment, the passive lighting is under 5 lux in intensity as measured at a distance of approximately 12 inches.

The device description provided herein is not intended to be inclusive and encompasses several alternative or additional iterations. For example, the device can include user adjustability to increase or decrease the manufacturer's settings of the period of time that the light remains on or of the intensity of light (such as from a fader switch). Additionally, instead of an LED bulb, the lamp source can be a strand of fiber optic or an energized and glowing florescent plastic part and could be provided in a variety of colors. The sensor lens cover of the device can be adjustable to maximize sensitivity for the particular application. For example, the device, lens, or lens cover can tilt between vertical and horizontal. In one embodiment, the tilt angle can be 15 degrees to the horizontal to sense motion at specified distance from a bedside table. In another embodiment, the PIR and sensor lens cover can be adjusted to achieve maximum sensitivity in a near vertical direction to sense a person's hand movement, which might be nearly overhead of the device. In this arrangement the sensor lens cover would be positioned on the top surface of the top platform. Further, to achieve maximum sensitivity in the horizontal plane the sensor lens cover would be positioned in a horizontal plane and would exist from the side of the base part of the enclosure.

Other possible variations of the device envision where the top platform of the enclosure includes a recess of sufficient size and shape to accept various household items, such as medication containers. This recess could be several millimeters deep and be capable of receiving a lid that closes to protect the contents, or the inside of the recess, from dust. Alternatively, the top platform of the enclosure could have a recess of sufficient size and shape to accept a transparent plastic drinking cup. The recess could be several millimeters deep to provide stability to the drinking cup. When residing in the recess, the drinking cup could cover the light chamber disc cover such that passive lighting could travel through the transparent drinking cup to make it easier to discern the drinking cup in a darkened room or darkened space.

Alternatively still, the top platform of the enclosure could accept an attachment that housed accessories. The accessory attachment could insert or detach from the platform and be of sufficient size and shape to accept and store household items such as medication containers, pills, or the like. Alternatively still, the top platform of the enclosure could contain an LED readout screen to communicate messages to the user. Alternatively still, an adjustment switch could be contained on the bottom part of the enclosure that could allow the user to control the light intensity of the LED, to control the time duration of the LED, to turn on or off the device, or to control the fading on or off of the LED (e.g. whether the LED would fade on and off or simply turn on and off without fading).

Alternatively still, an adjustment switch could be contained on the bottom part of the enclosure that would enable the user to turn the LED light on perpetually without regard to motion detection. Further, a battery low indicator could be contained on the device, such as on the bottom part of the enclosure, to warn a user when batteries are low in power. Thus, the device as described herein should not be limited in any manner and can entail these or other additions and variations.

While the invention has been disclosed in its preferred forms, it will be apparent to those skilled in the art that many modifications, additions, and deletions can be made therein without departing from the spirit and scope of the invention or its equivalents as set forth in the following claims.

We claim:

1. A portable illumination device capable of receiving a portable item, the device comprising:

a sensor capable of detecting the presence of an object exterior the device; and a light source contained in a light receptacle causing the light to reflect off a wall of the light receptacle when illuminated upon said sensor detecting the presence of the object, wherein the light source illuminates the portable item;

a seal adjacent an upper surface of the device that prevents liquid passage to an interior portion of the device;

the light source being connected to the sensor and being capable of illuminating upon detection of the object by the sensor; and the light source switches off after the sensor fails to detect the presence of the object.

2. The device of claim 1, wherein the sensor is capable of detecting stimuli produced by said object including heat, motion, or a combination thereof.

3. The device of claim 2, wherein said object is a person.

4. The device of claim 1, wherein said light source produces passive light upon detecting the presence of the object.

5. The device of claim 1, wherein the light source is illuminated for a set period of time and automatically switched off after the period of time has lapsed.

6. The device of claim 5, wherein the light source is triggered only after a delay time period passes once the set period of time lapses.

7. The device of claim 5, wherein the light source can be triggered immediately after the set period of time lapses.

8. The device of claim 1, wherein the sensor is disposed on the top side of the device.

9. The device of claim 1, wherein the sensor is disposed in a side of the device.

10. The device of claim 1, further comprising a sensor lens cover, wherein said cover comprises an array of enhancing surfaces to augment the sensing capabilities of the sensor.

11. The device of claim 1, further comprising a light chamber and light chamber cover.

12. The device of claim 11, wherein the light chamber cover is tinted blue.

13. The device of claim 11, wherein the light chamber has a diffuser lens.

14. The device of claim 13, wherein the light chamber has a floor, wherein the diffuser lens receives light reflected off the floor and diffuses the light to the light chamber cover.

15. The device of claim 1, further comprising raised walls capable of retaining the portable item.

16. The device of claim 1, further comprising a photo-cell that detects ambient lighting conditions.

17. The device of claim 16, wherein the light source is disabled if the photo-cell detects a minimum level of ambient light.

18. The device of claim 1, wherein the sensor is a PIR sensor.

19. A portable illumination device capable of receiving a portable item, the device comprising:

a light source in a light receptacle;

the light source controlled by a sensor that is capable of detecting the presence of an object that is exterior the device and of illuminating a surrounding area upon detection of the object;

a seal adjacent an upper surface of the device that prevents liquid passage to an interior portion of the device;

while the portable item remains in contact with the device, the light source switching off after the sensor fails to detect the presence of the object;

the object being in the proximity of the device, but not being in direct contact with the device; and an internal power source.

20. The device of claim 19, wherein the sensor is capable of detecting stimuli produced by said object including heat, motion, or a combination thereof.

21. The device of claim 20, wherein said object is a person.

22. The device of claim 19, wherein said light source produces passive light upon detecting the presence of the object.

23. The device of claim 19, further comprising raised walls capable of retaining a portable item.

24. A portable illumination device capable of receiving a portable item, the device comprising:

a sensor capable of detecting the presence of an object exterior the device, wherein the sensor is capable of detecting motion, heat, or a combination thereof;

a sensor lens cover, wherein said cover comprises an array of enhancing surfaces to augment the sensing capabilities of the sensor;

a light chamber, which comprises a floor capable of reflecting light to a diffuser lens within said chamber, wherein said diffuser lens is capable of diffusing light to a light chamber cover;

a photo-cell capable of detecting ambient lighting conditions;

a light source which illuminates upon said sensor detecting the presence of an object, wherein the light source illuminates the portable item and the surrounding area of said device; wherein while the portable item remains in contact with the device, the light source switches off after the sensor fails to detect the presence of the object; and an internal power source.

25. An illumination device capable of providing passive lighting comprising:

an upper surface including raised walls capable of receiving and retaining a portable item thereon;

a sensor capable of determining motion exterior the device to trigger a light source; and a photo-cell that detects ambient lighting conditions to disable triggering of the light source;

wherein the light source illuminates the item and surrounding area when triggered.

26. The device of claim 25, wherein the light source is illuminated for a set period of time and automatically switched off after the period of time has lapsed.

27. The device of claim 26, wherein the light source is triggered only after a delay time period passes once the set period of time lapses.

28. The device of claim 26, wherein the light source can be triggered immediately after the set period of time lapses.

29. The device of claim 25, further comprising a sensor lens cover comprising an array of enhancing surfaces to augment the sensing capabilities of the sensor.

30. The device of claim 25, further comprising a light chamber covered by a light chamber cover.

31. The device of claim 30, wherein the light chamber cover is tinted blue.

32. The device of claim 30, wherein the light chamber has a diffuser lens.

33. The device of claim 32, wherein the light chamber has a floor and wherein the diffuser lens receives light reflected off the floor and diffuses the light to the light chamber cover.

34. The device of claim 25, wherein triggering of the light source is disabled when the photo-cell detects a minimum level of ambient light.

35. The device of claim 25, wherein the sensor is a PIR sensor.

36. The device of claim 25, wherein the raised walls have a geometry that interacts with the item for retention of the item on the upper surface.

37. A method of illuminating a portable item by a device capable of providing passive light, the device including an area capable of receiving the item, a seal that prevents liquid passage to an interior portion of the device, and a sensor capable of sensing motion to trigger a light source, wherein the device houses a light chamber covered by a light chamber cover, wherein the light chamber has a floor, wherein a diffuser lens is disposed in the light chamber, the method comprising:

sensing motion exterior the device and triggering the light source;

reflecting the light off the floor of the light chamber;

diffusing the light with the diffuser to the light chamber cover; and switching off the light source after the sensor fails to detect the presence of an object but while the portable item remains in contact with the device.

38. The device of claim 1 wherein the seal includes a channel to direct liquid away from the interior portion.

39. The device of claim 19 wherein the seal includes a channel to direct liquid away from the interior portion.

40. The device of claim 25 further including a seal adjacent the upper surface that prevents liquid passage from the upper surface to an interior portion of the device.

41. The device of claim 40, wherein the seal includes a channel to direct liquid away from the interior portion.

* * * * *